US006484790B1

(12) United States Patent
Myers et al.

(10) Patent No.: US 6,484,790 B1
(45) **Date of Patent: *Nov. 26, 2002**

(54) METALLURGICAL BONDING OF COATED INSERTS WITHIN METAL CASTINGS

(75) Inventors: Martin R. Myers; Michael J. Warwick; Yongching Chen, all of Columbus, IN (US); Ramesh Subramanian, Oviedo, FL (US); Srinath Viswanathan; Karren More, both of Knoxville, TN (US); Quingyou Han, Beijing (CN)

(73) Assignees: Cummins Inc., Columbus, IN (US); UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/386,519

(22) Filed: Aug. 31, 1999

(51) Int. Cl.[7] ..... B22D 19/00; B22D 17/06

(52) U.S. Cl. ..... 164/100; 164/310

(58) Field of Search ..... 164/100, 310, 164/349; 205/170, 224, 227, 228

(56) References Cited

U.S. PATENT DOCUMENTS

| | | | | |
|---|---|---|---|---|
| 237,635 A | * | 2/1881 | Sneider | 164/349 |
| 929,778 A | | 8/1909 | Monnot | 428/649 |
| 1,710,136 A | | 4/1929 | Angle et al. | 123/193.3 |

(List continued on next page.)

FOREIGN PATENT DOCUMENTS

| | | |
|---|---|---|
| DE | 876 575 | 5/1953 |
| DE | 1 033 479 | 7/1958 |
| DE | 10 91 712 | 10/1960 |
| DE | 24 08 500 A1 | 9/1975 |
| DE | 38 16 348 A1 | 11/1989 |
| WO | WO 99/43 457 | 9/1999 |

OTHER PUBLICATIONS

Frederick A. Lowenheim, "Electroplating", Jan. 1979, McGraw–Hill, pp. 117–119, 201, 218, 219, 259.*

"Alloy Iron Ring Carriers Reduce Cylinder Wear", Auto Industries, vol. 68, No.19, May 1933, pp. 578–582.

"Engineering for Aluminum–Alloy Castings", by T.R. Gauthier and H.J. Rowe of ALCOA, Mechanical Engineering, vol. 70, No. 6, Jun. 1948, pp. 505–514.

"Aluminum Cylinder Blocks Cast in Permanent Molds", J.A. Lucas, Am. Mach, vol. 66, No.4, Jan. 1928, pp. 173–174.

"Current Status of Composite Casting as Bonding Technique", J.H. Beile and C.H. Lund, Metals Eng. Quarterly, vol.6, No. 1, Feb. 1966, pp. 63–64.

"Bonding Iron to Aluminum by Casting–On", Light Metals, vol. 21, No. 248, Nov. 1958, pp. 355–356.

Copy of German Office Action dated Jan. 16, 2002.

*Primary Examiner*—M. Alexandra Elve
*Assistant Examiner*—Kevin McHenry
(74) *Attorney, Agent, or Firm*—Nixon Peabody LLP; Charles M. Leedom, Jr.; Jerome W. Massie, IV

(57) ABSTRACT

A method for forming light-weight composite metal castings incorporating metallurgically bonded inserts for a variety of applications. Castings formed by the invention have particular utility as components of an internal combustion engine. A casting method includes the step of coating the insert with a first layer under conditions including sufficient temperature to cause a portion of the layer to be sacrificed by dissolving into the cast metal material while leaving at least a portion of the first layer as a diffusion barrier between the insert and the cast material. The molten casting material is treated and handled to keep the hydrogen content below 0.15 and preferably below 0.10 parts per million. The casting step takes place under a protective gas environment of dry air, argon or nitrogen with a moisture content of less than 3 parts per million.

65 Claims, 13 Drawing Sheets

U.S. PATENT DOCUMENTS

| | | | | | |
|---|---|---|---|---|---|
| 2,396,730 | A | | 3/1946 | Whitfield et al. | 22/204 |
| 2,554,670 | A | | 5/1951 | Ewing | 28/71.6 |
| 2,849,790 | A | | 9/1958 | Zwicker et al. | 29/196.2 |
| 2,881,491 | A | | 4/1959 | Jominy et al. | 22/204 |
| 3,165,983 | A | | 1/1965 | Thomas | 92/169 |
| 3,192,073 | A | | 6/1965 | Jominy et al. | 148/3 |
| 3,276,082 | A | | 10/1966 | Thomas | 22/204 |
| 3,708,088 | A | * | 1/1973 | Lesher | 222/70 |
| 3,945,423 | A | | 3/1976 | Hannig | 164/75 |
| 4,049,248 | A | * | 9/1977 | Gjosteen et al. | 266/202 |
| 4,980,123 | A | * | 12/1990 | Gedeon et al. | 419/8 |
| 4,997,024 | A | * | 3/1991 | Cole et al. | 164/75 |
| 5,005,469 | A | | 4/1991 | Ohta | 92/169.4 |
| 5,182,854 | A | | 2/1993 | Voss | 29/888.061 |
| 5,232,041 | A | | 8/1993 | Kuhn | 164/105 |
| 5,280,820 | A | | 1/1994 | Voss et al. | 164/100 |
| 5,333,668 | A | * | 8/1994 | Jorstad et al. | 164/100 |
| 5,408,916 | A | * | 4/1995 | Gorsky et al. | 92/227 |
| 6,006,819 | A | * | 12/1999 | Shimizu et al. | 164/100 |
| 6,186,072 | B1 | * | 2/2001 | Hickerson, Jr. et al. | 102/518 |

* cited by examiner 1 mil Ni annealed for 2 hours 1 mil Ni annealed for 4 hours

As-cast conditions (4 Mil Ni, 4 Hours)

High $H_2$

Medium $H_2$

Low $H_2$

4mil Ni/4mil Cu, as-cast condition

METALLURGICAL BONDING OF COATED INSERTS WITHIN METAL CASTINGS

BACKGROUND OF THE INVENTION

1. Technical Field

This invention relates generally to methods for forming tenacious bonds between inserts and cast metal materials such as reinforcing inserts for castings of internal combustion engine components.

2. Description of the Prior Art

The substitution of light weight casting material, such as aluminum alloys, for cast iron is a known approach for weight reduction in a variety of applications such as internal combustion engine manufacture. For example, the use of aluminum alloys to form internal combustion components is well known for automotive engines or high performance racing or aircraft engines. Such substitutions, however, have often resulted in compromised performance and/or reliability.

A well known solution to some of the performance and reliability problems associated with the use of light weight casting material as a substitute for cast iron has been to provide high strength inserts at critical points where severe wear or high stress is known to occur.

One approach has been to substitute aluminum pistons with nickel-iron ring carriers for conventional cast iron designed as disclosed by E Mahle, "Alloy Iron Ring Carriers Reduce Cylinder Wear", Auto Industries, Vol. 68, No. 19, May 1933, p578–82. However, wear of ring lands and rings in aluminum pistons causes reduction in engine output, blow-by of combustion gases, increased oil consumption, increased fuel consumption and piston slap (noise). Early attempts to correct these drawbacks involved placing gray iron inserts which had a coefficient of thermal expansion (CTE) of 0.0000067 in/in-° F. in aluminum pistons, which had a coefficient of thermal expansion of 0.0000134 in/in-° F. The differences in thermal expansion caused the carrier to loosen. The first successful pistons employed an aluminum-silicon alloy with a CTE of 0.000010 in/in-° F. with a Ni-resist carrier of about the same CTE. The Ni-Resist is an alloyed iron with 15% Nickel and 5% copper. When a Ni-Resist with even higher nickel and molybdenum content was used, an aluminum-copper alloy could be used for the piston, with improvements in thermal conductivity, machinability as well as thermal fatigue resistance.

However, when a ferrous alloy of low coefficient of thermal expansion is used, the tendency will be for the aluminum to grow against the restraining iron band during each heating cycle. This may minutely upset the aluminum so that when it cools, the fit will not be as close as it was originally. Subsequent heating cycles will exaggerate this condition until the ring band itself loosens on the piston.

Weight reduction by replacement of cast iron by light weight alloys incorporating inserts has not found general acceptance in heavy-duty diesel engines because of the severe performance and durability demands of the markets in which they have traditionally been used. One explanation for this is the difficulty of achieving an effective, durable metallurgical bond between the insert and the adjacent light weight cast material. For example, in "Engineering for Aluminum-Alloy Castings", by T R Gauthier and H J Rowe of ALCOA, Mechanical Engineering, Vol. 70, No. 6, June 1948, p505–14, the authors discuss casting design from the standpoint of mechanical properties, section thickness, and the use of inserts. The authors assert that no metallurgical bond normally exists between inserts and aluminum. Projecting legs or dogs or at least knurling are said normally to be necessary to mechanically retain the insert in the casting, especially if a torque will be applied to the insert.

An exception to the general rule that light weight alloys with strengthening inserts are not generally used in diesel engines has been the use of aluminum pistons joined with cast iron ring carriers by an Al-Fin process disclosed in U.S. Pat. No. 2,396,730 to whitfield et al. Other techniques for pre-coating an insert prior to casting are disclosed in U.S. Pat. Nos. 2,849,790 to Zwicker et al.; U.S. Pat. No. 2,881,491 to Jominy et al.; U.S. Pat. No. 3,945,423 to Hannig, U.S. Pat. No. 4,997,024 to Cole et al. and U.S. Pat. No. 5,333,669 to Jorstad.

However, debond problems with the Ni-resist iron insert has given the Al-Fin process, and other pre-coat processes, a poor reputation. These pistons suffer from two problems. The first is that during casting the aluminum contracts more than the iron, which may place the interface in tension. The second problem with pistons of this type is the presence of brittle inter metallic compounds. It has been established that cracking in pistons occurs between gamma-$Al_3FeSi$ and a $Fe_3(Si_{.9}Al_{.1})$ phase. The presence of these compounds is a function of casting temperature, cooling rate and bath composition and is not an inherent feature of Al-fin bonding.

J A. Lucas, "Aluminum Cylinder Blocks Cast in Permanent Molds", Am. Mach., Vol., 66, No. 4, Jan. 1928, p173–174, describes a composite engine block including cast aluminum with several inserts. The liners were of cast iron with nickel added for wear resistance and to control thermal expansion. The liners were sand blasted and copper plated prior to being placed in the mold. The best casting alloy with regards to bonding to the inserts, soundness and proper shrinkage was experimentally found to be 99% aluminum 1% copper. Even small percentages of impurities were found to dramatically increase scrap rates.

J H Beile and C H Lund, "Current Status of Composite Casting as Bonding Technique", Metals Eng. Quarterly, Vol. 6, No. 1, Feb. 66, p63–4, disclose a bonding technique for achieving metallurgical bonding requiring an absolutely clean surface on the inserts. Practical methods to prevent oxidation are to employ vacuum, inert atmospheres, or reducing atmospheres.

"Bonding Iron to Aluminum by Casting-On", Light Metals, Vol. 21, No. 248, Nov. 1958, p355–6, describes the principles for producing metallurgical bonds between inserts and casting. This paper reports that the production of an intimate junction may be prevented by the presence of an oxide film on the outer surface of the aluminized coating on the insert.

Another approach that has been undertaken in an attempt to achieve acceptable metallurgical bonding between inserts and cast metal is disclosed in U.S. Pat. No. 5,429,173 to Wang et al. which discloses a casting process wherein the insert, such as a ferrous metal cylinder liner, is pre-coated with plural layers of alternating materials that are exothermically reactive to produce inter-metallic phases at the surface.

Yet another approach toward achieving an acceptably strong bond between cast aluminum alloy, such as would be suitable in forming an engine block, and inserts such as cast iron cylinder liners involves pre-coating the liner with a metal coating. Examples of such approaches are disclosed in U.S. Pat. No. 1,710,136 to Angel et al., U.S. Pat. No. 3,165,983 to Thomas and U.S. Pat. No. 5,005,469 to Ohta. While claims have been made that these methods produce metallurgical bonds, others have reported that such bonds are not formed on a consistent and reliable basis. See for example U.S. Pat. No. 5,280,820 to Voss et. al. This later patent discloses a method which attempts to overcome the deficiencies of the prior art by coating the insert with zinc, tin or cadmium or their alloys in a way to cause an outer oxidized surface to form, followed by the step of removing the oxidized surface, and casting molten metal, such as aluminum based material, around the insert to cause the coating to remelt and alloy with both the insert material and the cast material to form a metallurgical bond between the liner and cast material. While effective for the purposes disclosed, this later approach has the effect of allowing direct contact between the base material of the insert and the molten casting material. This direct contact can give rise to undesirable inter-metallic phases that negatively impact the quality of the bond.

While relevant, none of these prior art methods has been entirely successful in producing consistent, high strength bonds between inserts and light weight casting material that will meet the long term demands for reliability required in certain applications such as the manufacture of heavy duty diesel engine components. For example, prior art processes are prone to producing defective products caused by voids, gas porosity, and oxides. In many cases, the insert will simply drop off from the casting as the number of defects is so great that no metallurgical bond is formed whatever. Therefore weight reduction through the broad application of light weight casting material remains an unmet, yet highly desirable, goal for many applications including diesel engines particularly in certain diesel engine applications such as fall size pick-up automotive markets, marine markets and certain military applications.

SUMMARY OF THE INVENTION

An important objective of this invention is to overcome the deficiencies of the prior art by providing a casting method that forms high strength joints between inserts and light-metal casting material and by providing castings that consistently achieve an extremely low defect rate, high strength and long term durability.

An important objective of this invention is to provide a casting method for forming highly tenacious bonds such as metallurgical bonds between inserts and the casting material including the step of coating the insert with one or more layers of metallic material to a thickness that allows some, but not necessarily all, of the layer to be dissolved into the casting material to create a diffusion barrier that prevents the formation of undesirable inter-metallics, such as Fe—Al—Si.

Yet another objective of this invention is to provide a casting method as described above wherein the step of coating the insert includes coating a first layer onto the insert followed by a casting step under conditions including sufficient temperature to cause a portion of the first layer to be sacrificed by dissolving into the cast metal material while leaving at least a portion of the first layer as a diffusion barrier between the insert and the cast material. The coated layer may be applied by a variety of different coating processes such as electroplating to a thickness of 0.5 to 8 mils but 0.5 to 4 mils is desirable and 1 to 2 mils is still more desirable.

Another objective is to provide castings formed by the above method that have interfacial bond strengths between the insert(s) and the bonded cast material above 8,000 psi.

Still another objective is to provide castings that can be subjected to a heat treatment process (such as T5 or T6 processes) following casting without degradation of the bond strength or reduction in long term durability of the bond quality between the casting material and the insert.

Another object of the invention is to provide a casting method as described above involving pre-coating of the insert wherein the insert coating(s) has a coefficient of thermal expansion intermediate to that of the coefficients of thermal expansion of the insert material and the casting material.

Another objective of the subject invention is to provide a casting method for forming highly tenacious bonds between inserts and the casting material by seeking to reduce the amount of hydrogen and other contaminates that are absorbed in the molten casting material during melting and mold filling and to reduce otherwise the contamination of the cast material.

Still another object of the subject invention is to provide a casting method in which the molten cast material including aluminum is degassed to reduce the dissolved hydrogen concentration in the melt and thus reduce the amount of hydrogen that will precipitate at the aluminum/insert material interface during solidification.

A still more specific objective of the subject invention is to provide a casting method in which the molten cast material is degassed sufficiently to cause any porosity that may form to be smaller than that which can be seen by the naked eye on a cut transverse section of a reduced pressure test (RPT) sample. This amount of hydrogen should be less than 0.15 parts per million (ppm) and more ideally 0.10 ppm. These levels translate to less than 0.168 cubic centimeters per 100 grams of casting material (cc/100 gms) and 0.112 cc/100 gms.

Still another object of the invention is to provide a casting method for forming highly tenacious bonds between inserts and the casting material including the step of casting within a dry air or dry inert gas environment (such as argon or nitrogen) or under a vacuum to prevent hydrogen from being picked up by the molten casting material during the mold filling process thereby limiting the level of dissolved hydrogen in the molten casting material and keeping the resultant porosity level in the casting low. This objective can be aided by using argon having a moisture content below 3 ppm.

Yet another objective of the invention is to provide a casting method including the provision of a mold that is adapted to receive the insert(s) and that includes one or more inlets through which the molten cast material can enter the mold and one or more outlets through which excess molten casting material can be allowed to overflow during the casting process thereby causing oxides and other contaminates at the leading edge of the metal flow that would otherwise contaminate the interface to flow away from the interface. This feature of the invention allows the casting to be carried out at lower pouring temperatures since the larger quantity of metal prevents premature freezing of the metal, and thus reduces the dissolved hydrogen concentration in the melt.

It is yet another object of this invention to provide a casting method for forming highly tenacious bonds between inserts and the casting material wherein the casting-insert interface can be made substantially defect free by degassing the molten cast material, casting under dry air or dry inert gas protection or under vacuum and by using a mold that provides for entrained contaminants to flow away from the interface between the insert and casting material.

Yet another object of this invention is to provide a casting method as described above in which the insert may be formed of ferrous material such as carbon steel or stainless steel, the casting material may be formed of light weight metal alloy such as aluminum alloy and still more particularly 354 or A354 aluminum alloy and the coating materials may be selected from a group consisting of Ni, Ag, Cu, Antimony, Bismuth, Chromium, Gold, Lead, Magnesium, Silicon, Tin, Titanium, and Zinc.

Another object of this invention is to provide a casting method as described above including the step of cleaning the coated insert in an alkaline bath followed by the step of the acid cleaning.

Still another object of the invention is to provide a casting method as described above wherein the insert is coated with Ni at a temperature of 50° to 55° C. and if the layer is Cu the coating temperature should be 40° to 45° C. Thereafter the coated insert is annealed at a temperature 900° C.

Another object of this invention is to provide a novel casting including pre-coated inserts formed as described above and cast to form components of an internal combustion engine such as the head, block or pistons.

The above objects and advantages of the subject invention may be realized by a casting method including the steps of forming an insert, such as a cylinder liner or head re-inforcing element, formed of carbon steel or stainless steel. The insert surface is prepared and coated by an electroplating process with a layer of metal, such as Cu, Ni or Ag, having a coefficient of thermal expansion between the coefficients of thermal expansion of the insert material and the casting material. Next the coated insert is annealed at a temperature (e.g. 900° C.) sufficient to form appropriate diffusion bonds between the coated layer and the insert. To commence the casting process, the coated insert is baked at a temperature of at least 100° C. for at least 5 minutes to dispel absorbed moisture. A sand mold is prepared and the insert is placed in the sand mold. The sand mold may be dried by use of a heat lamp. The casting material (e.g. A354 or 354 aluminum alloy) is heated to 720° C. and the molten material is degassed. Casting proceeds under an atmosphere of argon to prevent absorption of hydrogen. The sand mold is formed to provide an inlet and an outlet to allow the leading edge of the molten flow to pass as overflow through the outlet thereby carrying contaminants away from the interface between the molten casting material and the coated surface of the insert. Finally the casting may be heat treated via a standardized heat treatment process known as T5 or T6.

Other and more specific objects of this invention may be perceived from the following Brief Description of the Drawings and the Description of the Preferred Embodiment.

DESCRIPTION OF THE PREFERRED EMBODIMENT

The subject invention is directed to a method for forming light-weight composite metal castings incorporating metallurgically bonded inserts for a variety of applications. Castings formed by the invention disclosed herein have particular utility as components of an internal combustion engine. More particularly, the disclosed invention achieves a level of consistency, predictability, high strength and long term durability that prior art castings could not achieve. As a result, castings made by the disclosed process are capable of meeting the very high performance and reliability requirements of heavy duty diesel engine users in ways that prior art castings can not.

Figure 1:
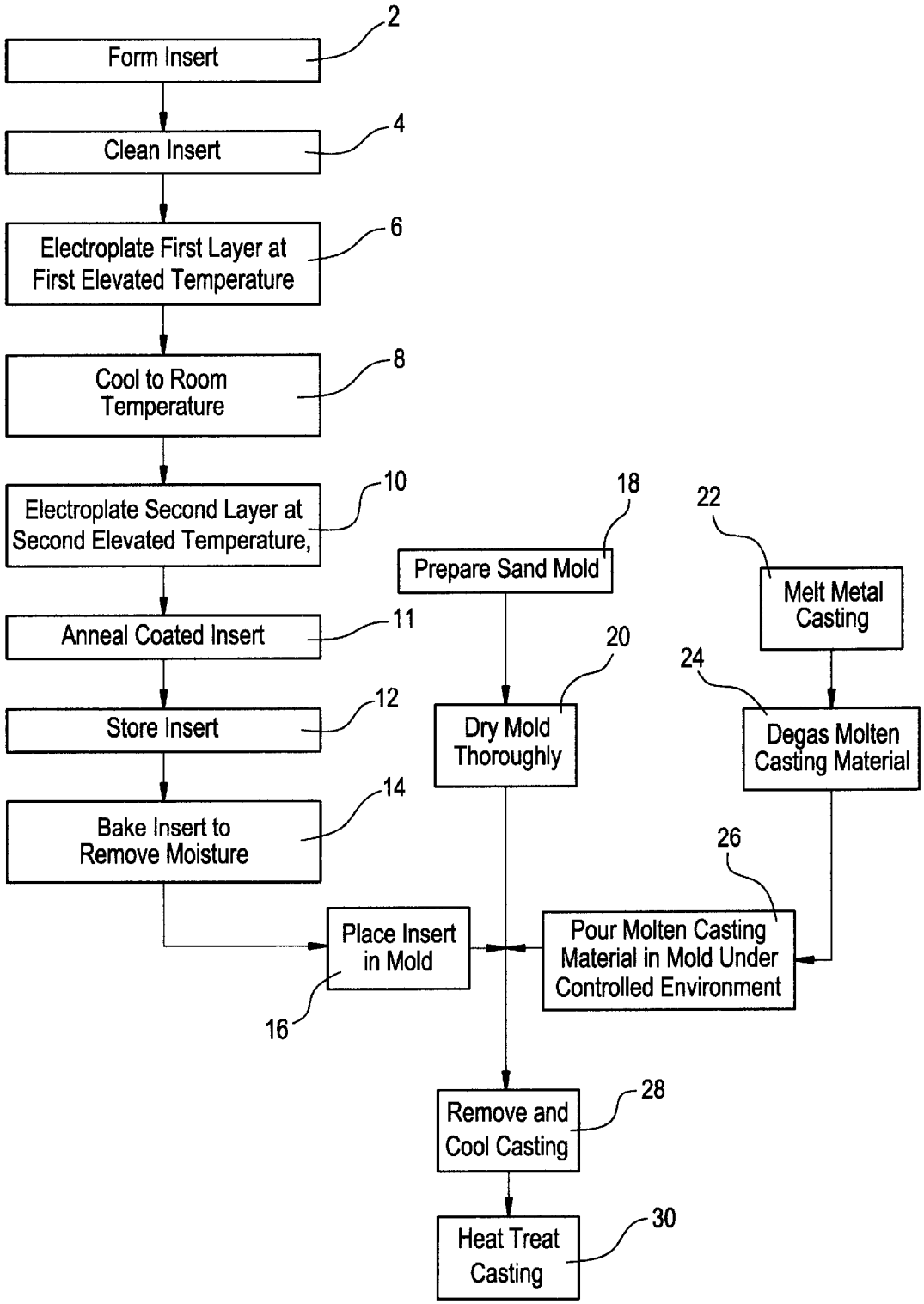
FIG. 1 is a chart of steps included in the casting process which is the subject matter of this invention.

FIG. 1 illustrates steps involved in practicing the subject invention. An important aspect of the invention is to properly form the insert in step 2 before it is placed in the casting mold. The insert may take a wide variety of forms and may be formed of a wide variety of materials depending on the functional purpose of the insert. For example the insert may serve as a cylinder liner wherein wear resistance, heat transfer capability and high strength are required. Alternatively, the insert may serve as a re-inforcing member in a critical portion of the head of an internal combustion engine where high strength and long term durability would be required. Yet another application would be as a ring carrier or head for an engine piston where still other performance criteria would apply. In many instances, the insert is likely to be formed of a ferrous metal such as cast iron, carbon steel or stainless steel but non-ferrous metal alloys or even ceramic materials may be used.

The insert could be cleaned in step 4 by a variety of known processes in order to render the surface that is to be joined to the casting material suitable to receive the coating material. For example, the insert may be subjected to anodic cleaning in an alkaline bath followed by cleaning in an acid. Once the insert has been suitably cleaned, a first thin layer may be coated in step 6 onto the insert such as by an electroplating process. The type of coating material selected is an important part of the subject invention and may be chosen from a wide variety of materials so long as the material is capable of forming a tenacious bond with the surface of the insert. For example the material may be Ni, Ag, Cu, Antimony, Bismuth, Chromium, Gold, Lead, Magnesium, Silicon, Tin, Titanium, and Zinc. Ni, Ag, and Cu have been extensively tested and found to be particularly effective when used in the present invention.

While the exact thickness of the coating has not been found to be especially critical, the first layer should have a thickness above about 0.5 mils in order to prevent the first layer from completely dissolving and allowing the casting material to directly contact the surface of the insert. On the other hand, the thickness should not exceed about 8 mils. Excessive thickness can lead to weakening of the joint between the insert and casting material. In most instances, the first layer should not exceed 4 mils and more preferably should be in the range of about 1 to 2 mils.

If the insert is to receive a single layer of Ni coating, the coating temperature should be 50 to 55° C. If the single layer is formed of Cu or Au, the coating temperature should be 40 to 45° C. When multi-layer coatings are used other temperature conditions are preferred. Reference is made the commonly owned co-pending application entitled METALLURGICAL BONDING OF INSERTS HAVING MULTI-LAYERED COATINGS WITHIN METAL CASTINGS filed on Aug. 31, 1999. The disclosure of this co-pending application is incorporated herein by reference.

Typically, the coefficient of thermal expansion of the casting material will be greater than of the insert material. While not required, it has been found that the coefficient of thermal expansion of the coating layer should be intermediate the coefficients of thermal expansion of the insert material and the casting material. Where multiple coating layers are used, the first layer coated on the insert should have a coefficient of thermal expansion between that of the insert material and the second coating layer. Likewise, the second coating layer should have a coefficient of thermal expansion between that of the first layer and the casting material. A bad match of coefficients of thermal expansion can increase the likelihood of layer debonding.

Electroplating is effective in achieving the highly tenacious bonding of the coated layer as desired for the subject invention. However, other coating processes could be used such as diffusion bonding, forming (extrusion, roll cladding, etc.), hot dipping (e.g. dipping into molten metal), sputtering, vapor deposition and/or weld cladding.

To improve the diffusion of metals between the coated layer and the insert, an annealing step 11 should be added to insure that appropriate metallurgical bonds are formed between the materials in the coated layer and the insert. For example, with a single coating layer, an appropriate annealing temperature might be 900° C. For multi-layers of Ni/Cu, 900° C. would also work well. For multi-layers of Ag/Cu, 720° C. would be appropriate.

One of the advantages of this invention is the fact that the inserts, once coated, may be stored in step 12. They do not need to be used immediately, as is the case with certain prior art processes. Just before they are to be used, however, the insert should be baked in step 14 to remove all moisture. For example, the insert could be baked at a temperature of at least 100° C. for at least 5 minutes prior to insertion in step 16 into the casting mold.

The casting mold may take a variety of different forms and may be formed in step 18 in accordance with a variety of known technologies. One particularly desirable form would be a sand mold suitable for the type of casting material to be used. In any event, it will be important for the mold to be completely dry during the molding process. To effect this result, the mold should be heated in step 20 prior to use such as by using a heat lamp for a sustained period (e.g. 6 hours).

Before the casting commences, the casting material must be melted in step 22 to a sufficiently high temperature and the melt is degassing in step 24. For example, the molten casting material is heated to 720° C. and the molten casting material is adequately degassed by using appropriate technique such as a rotary degasser or a porous lance. During degassing, the gas content in the melt needs to be reduced to an extent that any porosity that may form is smaller than that which can be seen by the naked eye on a cut transverse section of a reduced pressure test (RPT) sample. The RPT is a standard foundry test for assessing the level of gas/hydrogen in an aluminum alloy melt.

A variety of casting materials can be used in practicing the subject invention depending on the ultimate functional purpose of the casting. For example, a suitable light-weight casting material would be 354 or A354 aluminum alloy which is a premium aerospace casting alloy that would be suitable for both heads and blocks of internal combustion engines. However, other metal casting materials would be suitable such as C355 and C356 which are aerospace alloys that are also used for some automotive components including heads and blocks. Alloy 390 is a hypereutectic aluminum-silicon alloy with some unique properties including high modulus, hardness and wear resistance. Most aluminum alloys have an elastic modulus of approximately 10.5 Msi. The modulus of 390 is 11.9 Msi. This 10% increase in modulus translates into a more rigid casting.

As will be explained more thoroughly below, the mold should be designed to provide at least one inlet for the molten casting material and one outlet to allow the molten casting material to advance through the mold and to allow for a controlled amount of overflow through the outlet. By providing for this overflow, contaminants picked up by the molten casting material, for example by the leading edge of the flow, will be discharged from the mold. In the absence of overflow, dirty melt may be frozen into the interface between the casting material and the insert resulting in poor bonding.

Another feature of the subject invention is to carry out the mold casting step 26 within a protective gas environment. For example, it has been determined that entrainment of hydrogen within the molten casting material can lead to significant increases in defects and prevent adequate high strength bonding. See FIGS. 18*a*–18*c* below. The degassing step 24 is important in addressing this problem. Ideally the hydrogen content should be reduced below 0.15 parts per million (ppm) and more ideally 0.10 ppm. These levels translate to less that 0.168 cubic centimeters per 100 grams of casting material (cc/100 gms) and 0.112 cc/100 gms, respectively. Even after degassing hydrogen (and other contaminants) may be picked up during the casting process. By providing a gas environment that retards or eliminates hydrogen contamination during the casting process, the reliability, strength and consistency of the resulting insert/casting bond can be maintained. Dry air or dry inert gas protection during casting or casting under vacuum prevents hydrogen from being picked up by the melt during mold filling, limiting the level of dissolved hydrogen in the melt and keeping the resultant porosity level Once the casting is removed and cooled in step 28, it is desirable to heat treat the composite casting/insert by known heat treatment processes. For example the treatment may take the form of T5 or T6 treatment processes. T6 is the preferred treatment wherein the insert would be solution treated between 900 and 1000° for 8 to 12 hours, then quenched in hot water or a polymer solution. This is followed by aging which is generally carried out between 300 and 400° F. from 2 to 12 hours. Longer times and higher temperatures within these ranges are used to overage the matrix in order to improve thermal stability or reduce warpage and residual stresses. Consequently for cast-in inserts, the insert material, casting alloy and interface coatings must be chosen so that the interface can endure casting, air cooling, solution treatment, quenching, and then the aging treatment. If the toughness of the interface phases is low, then the interface must be kept as thin as possible in order to survive the quench without cracking. If the interface can be tailored to have ductile phases, then thickness is less important.

In situations where a less severe heat treatment is desirable, other types of treatment would be appropriate such as a T5 treatment. This type of treatment forgoes the solution treatment and quench of T6 but otherwise follows the same aging treatment. The difference in properties between the T5 and T6 vary considerably depending on alloy chemistry. In general tensile strength, yield strength and elongation are improved due to the solution treatment of T6. The difference in fatigue strength, especially at elevated temperatures, is unclear. If a T5 treatment must be used, there may be a need to increase section thicknesses or employ more inserts to achieve adequate reliability.

Figure 2:
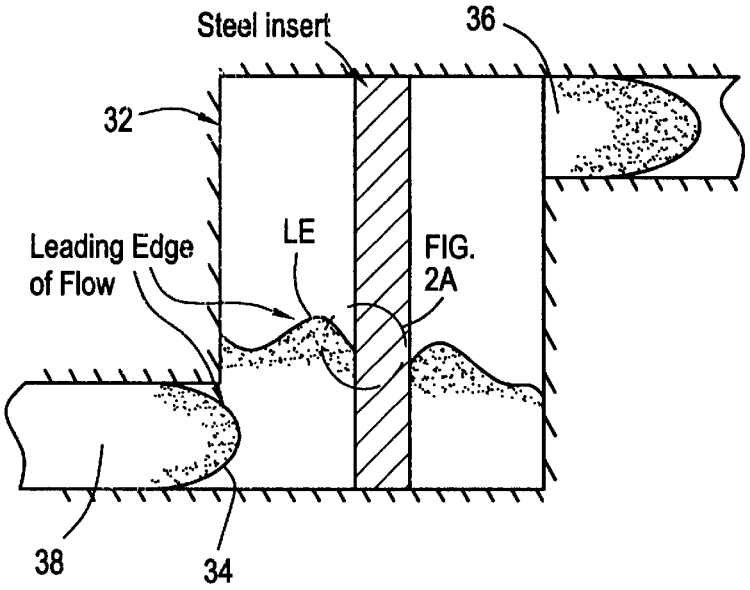
FIG. 2 is a schematic illustration of the overflow technique that causes contaminates to flow away from the bonding interface.
Figure 2A:
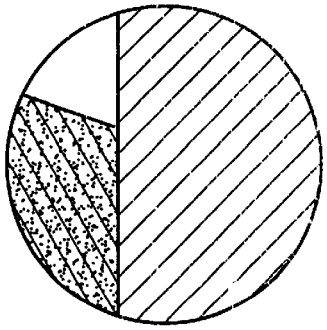

FIG. 2 illustrates schematically the form of a suitable casting mold 32 having at least one inlet 34 and at least one outlet 36. By forcing the molten casting material 38 through inlet 34, the leading edge LE of the molten flow will travel upwardly filling the mold and overflow through outlet 36. The overflowing portion of the molten casting material will discharge contaminates such as oxides and inclusions away from the interface between the insert and casting material. Alternatively the mold may be designed to direct the flow of the molten casting material into sections of the mold remote from the insert after the molten casting material flows over the coated insert surfaces to allow contaminants to be carried away from the coated surfaces. This flow pattern will cause the portion of the molten casting material, most likely to be contaminated with oxides and inclusions, to be directed away from the interface between the insert and casting material. FIG. 2*a* is a exploded view of the interface zone where, but for the overflow, initial dirty melt could freeze onto the surface of the insert thereby producing poor bonding.

Figure 3:
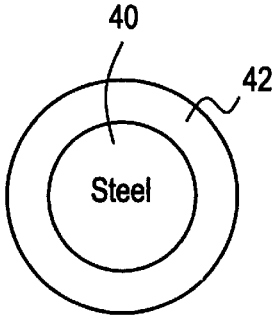
FIG. 3 is a schematic illustration of an insert coated with a single layer and cast within a sample casting in accordance with the subject invention.
Figure 4A:
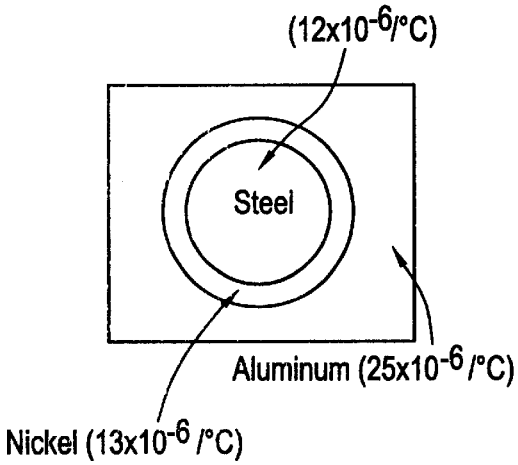
FIGS. 4*a* and 4*b* are schematic illustrations of the way in which the coated insert of FIG. 3 may be cast in accordance with the subject invention.
Figure 4B:
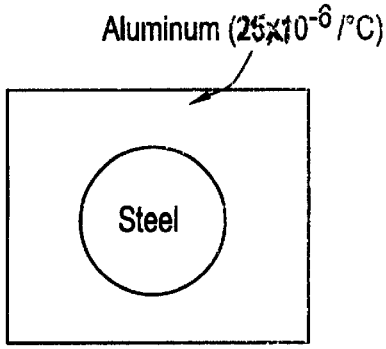

FIG. 3 illustrates a steel insert 40 initially coated with a single layer 42 of Ni. Depending on a number of factors, such as the thickness of the coating, the temperature and chemical nature of casting material and the molten flow pattern within the mold, the coating may either be partially dissolved or wholly dissolved during the casting step. Each of these results are illustrated in FIG. 4*a* and FIG. 4*b* respectively. FIG. 4*a* includes values for the coefficients of thermal expansion of the insert material ($12\times10^{-6}$/° C.), the Ni coating material ($13\times10^{-6}$° C.) and the aluminum casting material ($25\times10^{-6}$/° C.). While the embodiment of FIG. 4*b* may enjoy some of the benefits of this invention, it is preferable to implement the casting process to produce the configuration of FIG. 4*a* because this configuration allows a portion of the Ni coating to remain throughout the formation and heat treatment processes and thereafter to prevent undesirable intermetallic phases to be formed.

Figure 5:
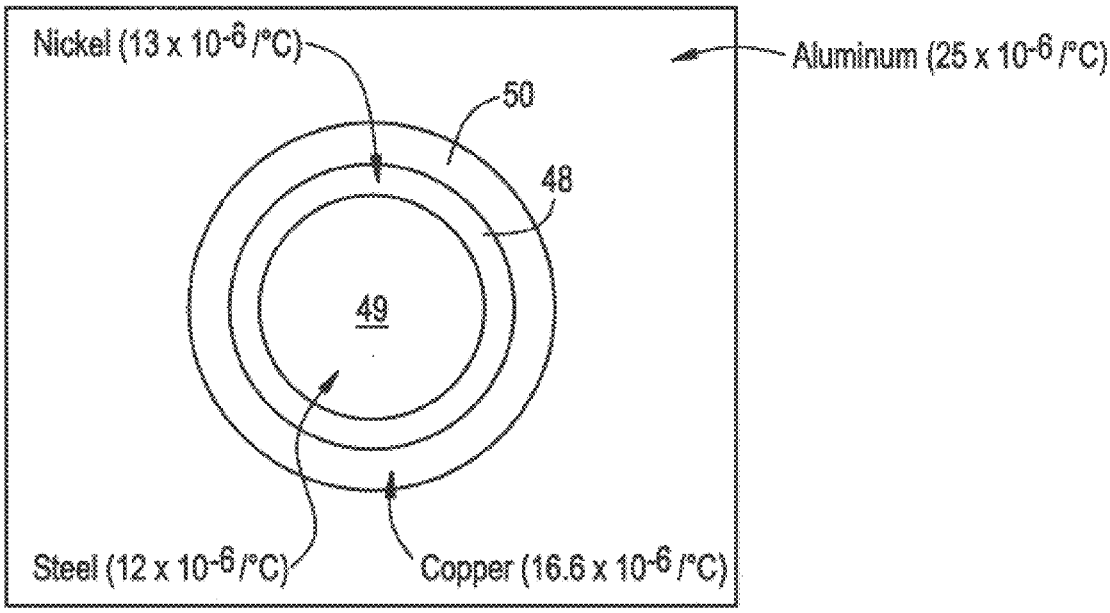
FIG. 5 is a schematic illustration of another insert coated with multiple layers (including Ni and Cu) and cast within a sample casting in accordance with the subject invention.

FIG. 5 illustrates a specific example of a casting formed by the method of this invention in which the insert 49 is formed of steel and has a plurality of coatings bonded thereto in accordance with the subject invention. The first layer 48 that was electroplated onto the insert is Ni and the second layer 50, also electroplated, is Cu. Again the coefficients of thermal expansion follow the desired order with the insert being the lowest $12\times10^{-6}$/° C., the first layer (Ni) being $13\times10^{-6}$/° C., the second layer (Cu) being $16.6\times10^{-6}$/° C. and the casting material (aluminum) being $25\times10^{-6}$/° C.

Figure 6:
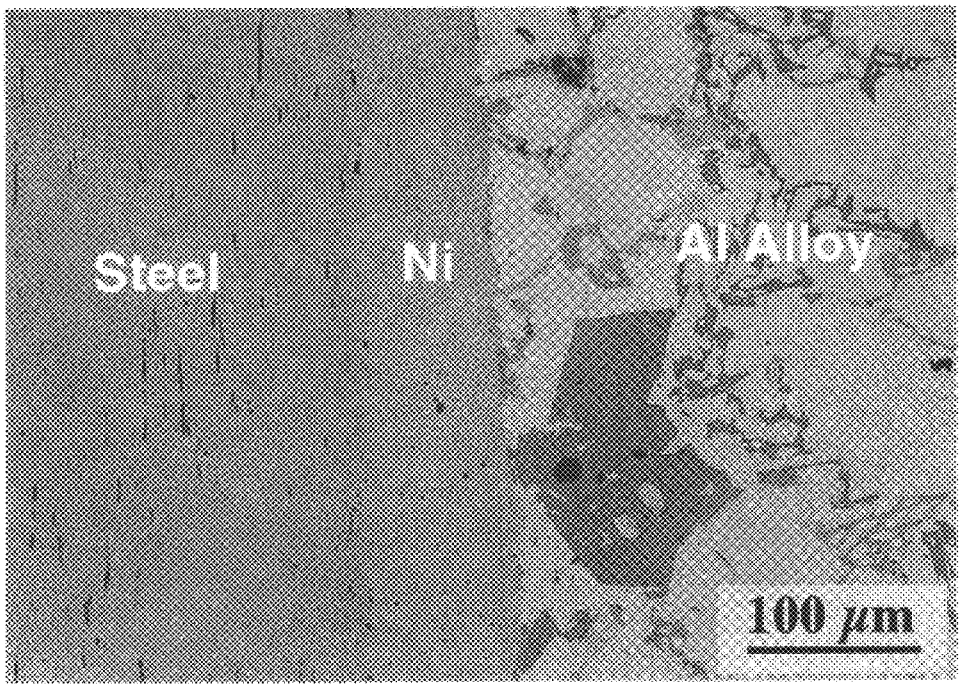
FIG. 6 is a micrograph of the metallurgical bond formed in the embodiment of FIG. 4.

FIG. 6 is an optical micrograph of the steel insert metallurgically bonded to aluminum after the aluminum was cast around the steel insert coated with Ni to a thickness of 4 mil followed by a coating of Cu to a thickness of 4 mil.

Figure 7:
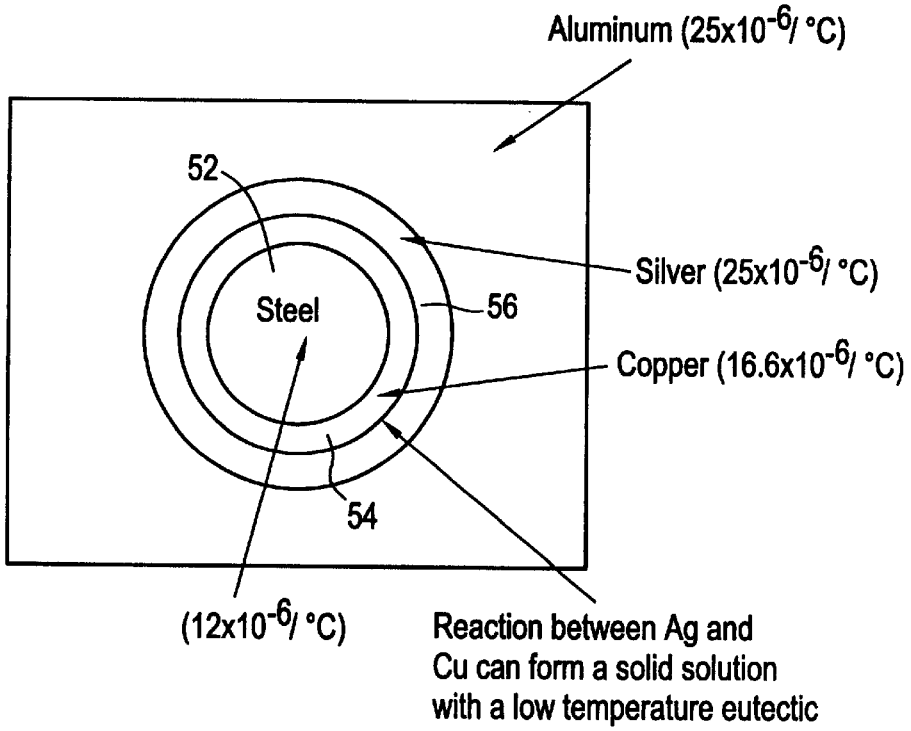
FIG. 7 is a schematic illustration of another insert coated with multiple layers (including Cu and Ag) and cast within a sample casting in accordance with the subject invention.
Figure 8:
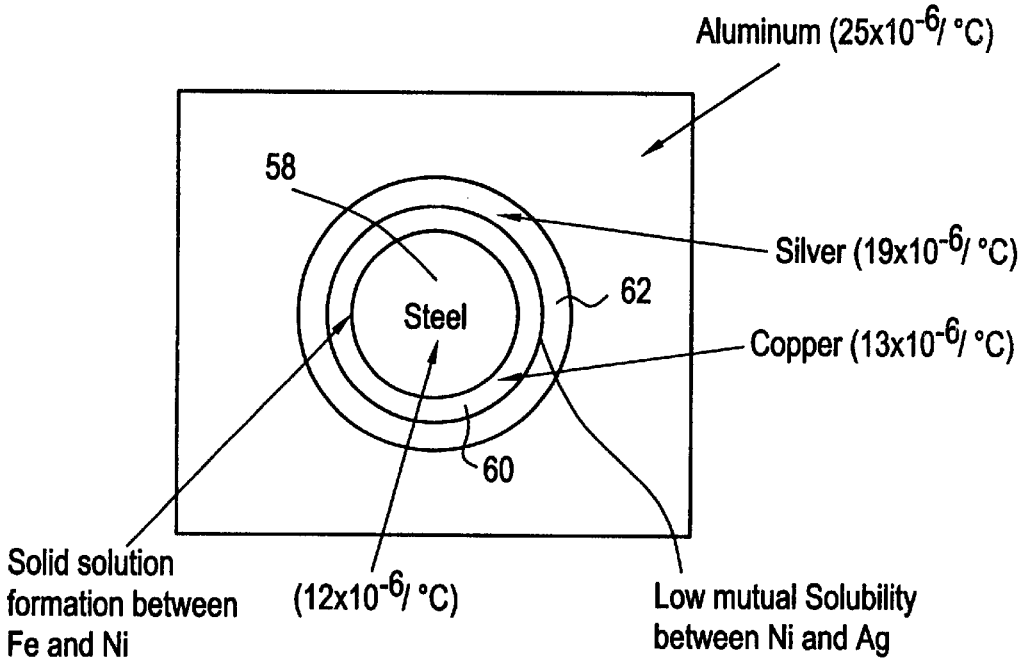
FIG. 8 is a schematic illustration of yet another insert coated with multiple layers (including Ni and Ag) and cast within a sample casting in accordance with the subject invention.

FIG. 7 illustrates another example of a multi-layered coated insert 52. This time the first layer 54 is formed of Cu and the second layer 56 is formed of Ag. This embodiment of the invention illustrates another example of the thermal expansion gradient. As shown in FIG. 7, the Ag layer can act as a sacrificial layer and allow bonding between the Cu and Al layers. In this instance, the Cu would act as a diffusion barrier for the formation of Fe—AL—Si In the example of FIG. 8, the insert 58 has been electroplated first with a layer of Ni 60 and second layer of Ag 62. In this instance the Ag layer is a sacrificial layer allowing bonding between the Ni layer and the aluminum casting material. In this instance the Ni layer 60 would act as a diffusion barrier against the formation of Fe—Al—Si intermetallics.

Figure 9:
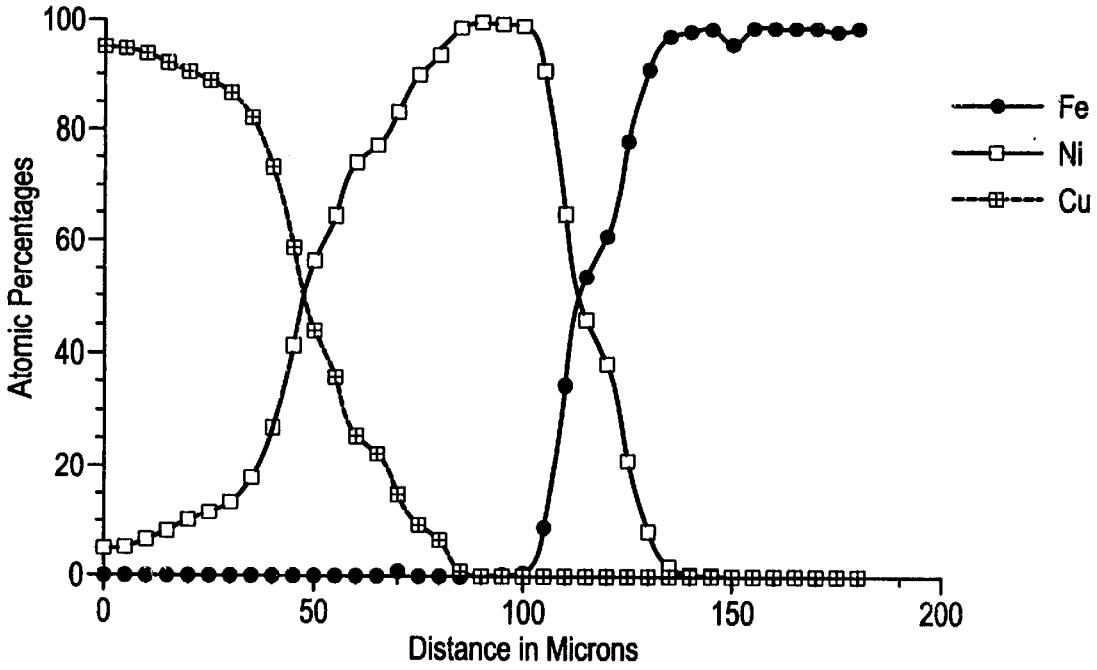
FIG. 9 is a graph of the atomic concentrations of Fe, Ni and Cu of a coated insert formed by the subject invention after annealing.

Referring now to FIG. 9, this graph illustrates the effects of an annealing step before casting-in of the insert. The plot illustrates atomic concentrations of Fe, Ni and Cu versus the distance from the surface of the coated insert after annealing for 4 hours at 900° C.

Figure 10:
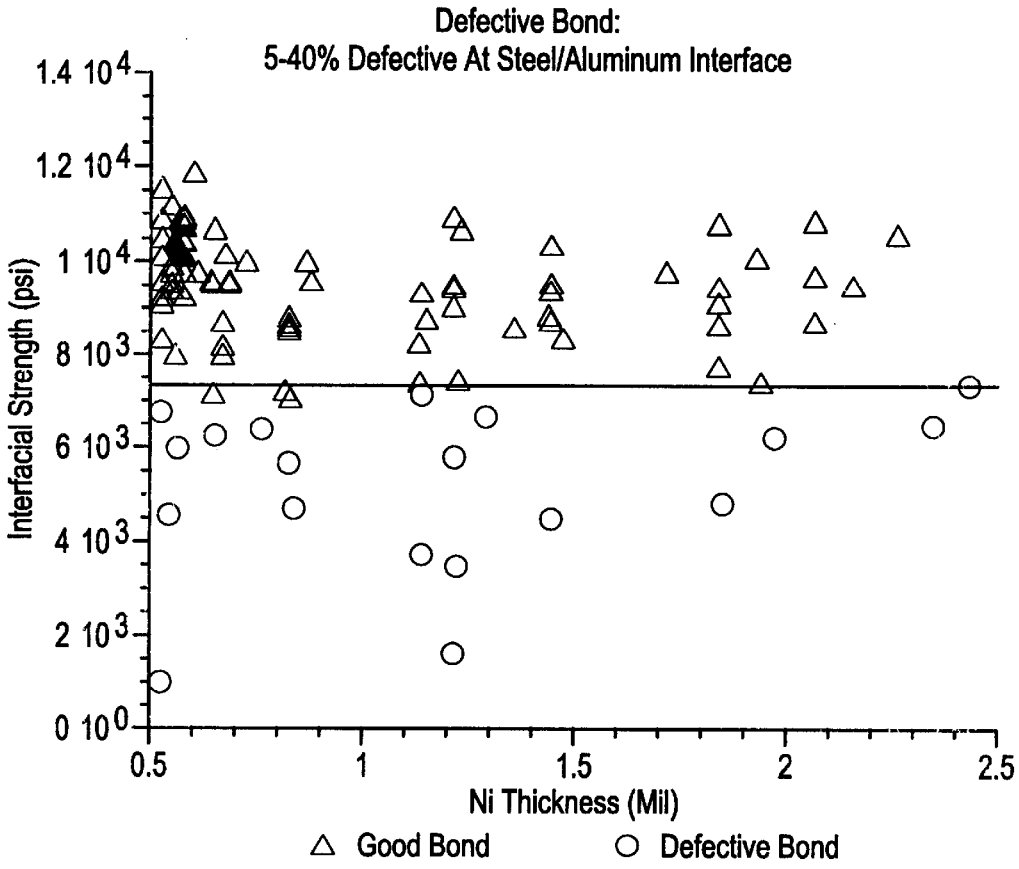
FIG. 10 is a graph demonstrating that defects at the steel/aluminum interface reduce bond strength.

FIG. 10 is a graph that demonstrates that defects at the steel/aluminum interface reduce bond strength substantially.

Figure 11A:
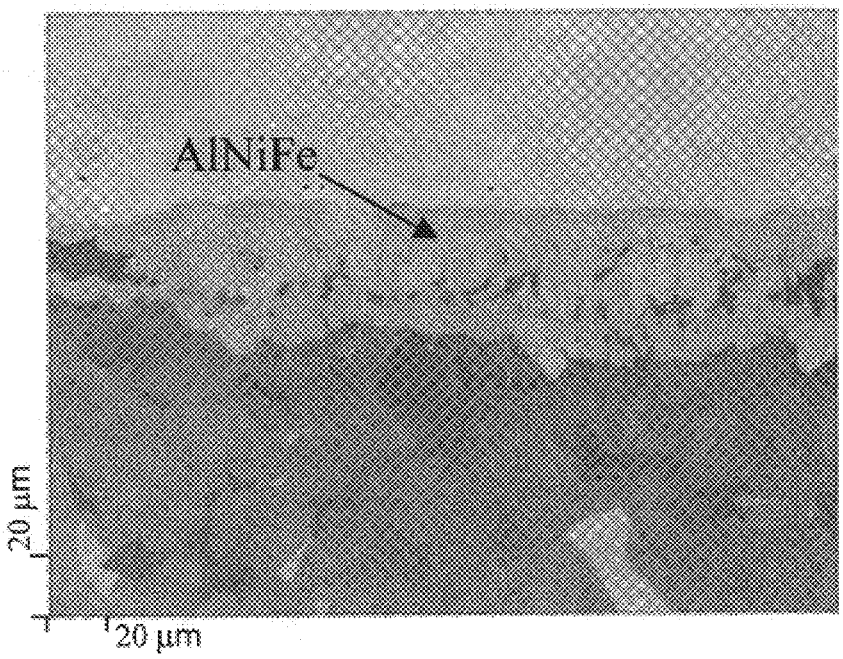
FIGS. 11*a* and 11*b* are micrographs of interfacial regions of an Al to steel bond showing the occurrence of Al—Si—Fe intermetallics.
Figure 11B:
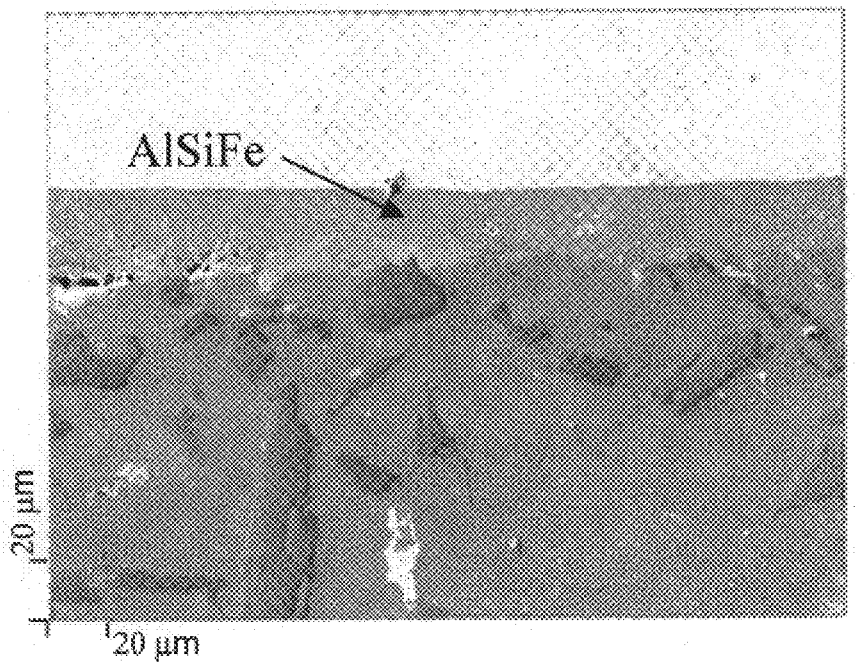

FIGS. 11*a* and 11*b* are micrographs of a cross-section at the interface of a sample casting of Al/Ni/Fe showing the Al—Si—Fe intermetallic phases occuring at the bond for samples coated with 1 mil Ni and annealed for 4 hours.

Figure 12:
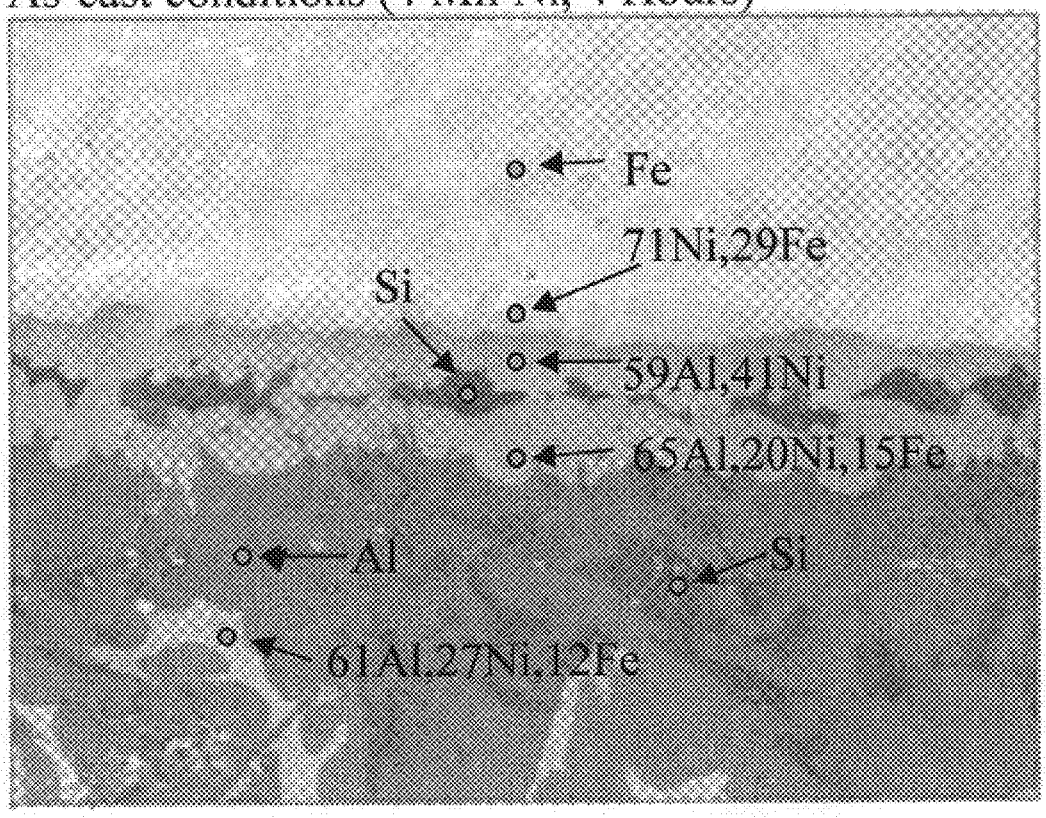
FIG. 12 is a micrograph of the interfacial regions of an Al to steel bond disclosing the occurrence of nickel aluminides.
Figure 13A:
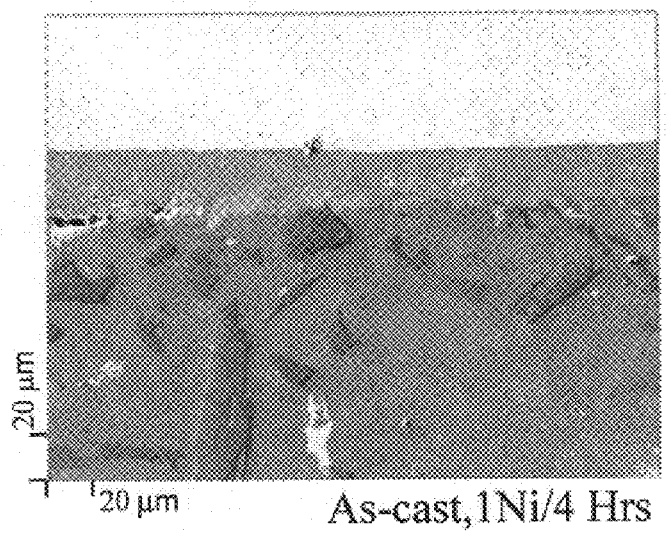
FIGS. 13*a*–13*c* disclose comparative micrographs of intermetallics in bonded samples formed in accordance with the subject invention for a sample "as-cast", a sample subjected to a T5 heat treatment and a sample subjected to a T6 heat treatment, respectively.
Figure 13B:
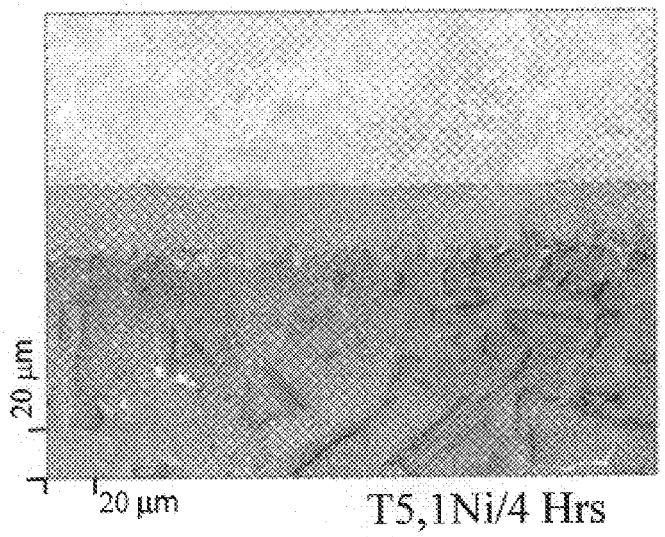
Figure 13C:
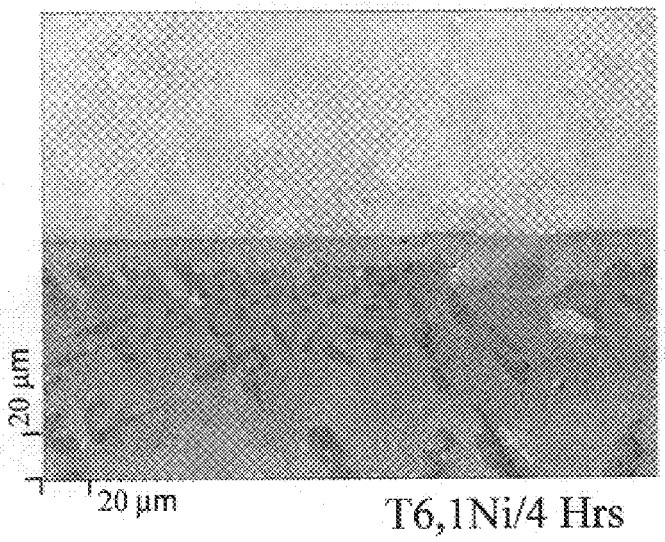

FIG. 12 is a micrograph demonstrating that Nickel aluminides occur at the steel/aluminum interface of samples formed in accordance with the invention. FIGS. 13*a*, 13*b* and 13*c* demonstrate that harmful Al—Si—Fe intermetallics do not grow much during heat treatment. FIG. 13*a* illustrates conditions after casting of data derived from testing casting samples made in accordance with the subject invention but without heat treatment. FIG. 13*b* illustrates conditions after treatment in accordance with T5 heat treatment and FIG. 13*c* illustrate conditions after treatment in accordance with T6 heat treatment.

Figure 14:
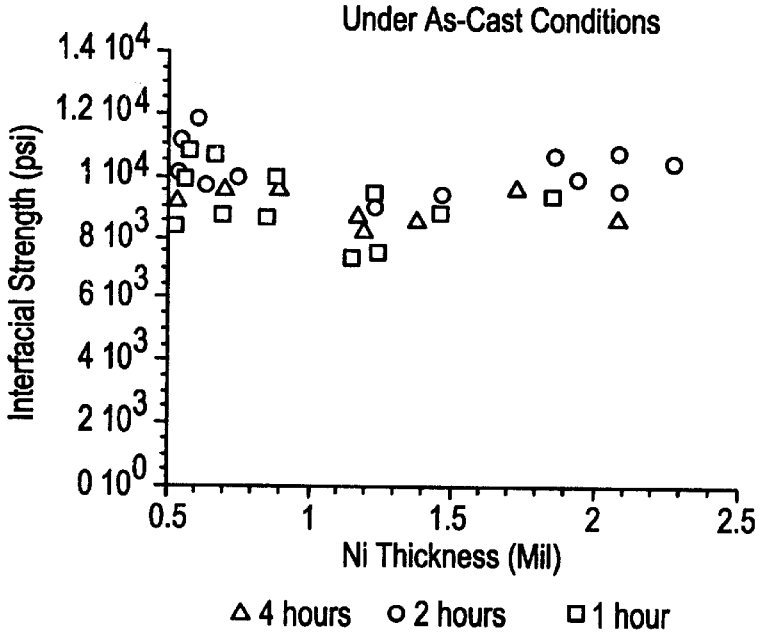
FIGS. 14 is a graph illustrating the high bond strength obtained by the subject invention.

FIG. 14 is a graph of data derived from testing casting samples made in accordance with the subject invention that illustrates that high bond strength is obtained for castings in the as-cast condition. The bond strength is between 8,000–12,000 psi, higher than that of castings formed by the Al-Fin process (in the range of 7,200 psi). The bond strength is hardly affected by the Ni thickness in the range between 0.5 to 2.5 mils, although a thin coating seems to have higher strength. This graph also demonstrates that diffusion bonding time seems to have little effect on bond strength.

Figure 15:
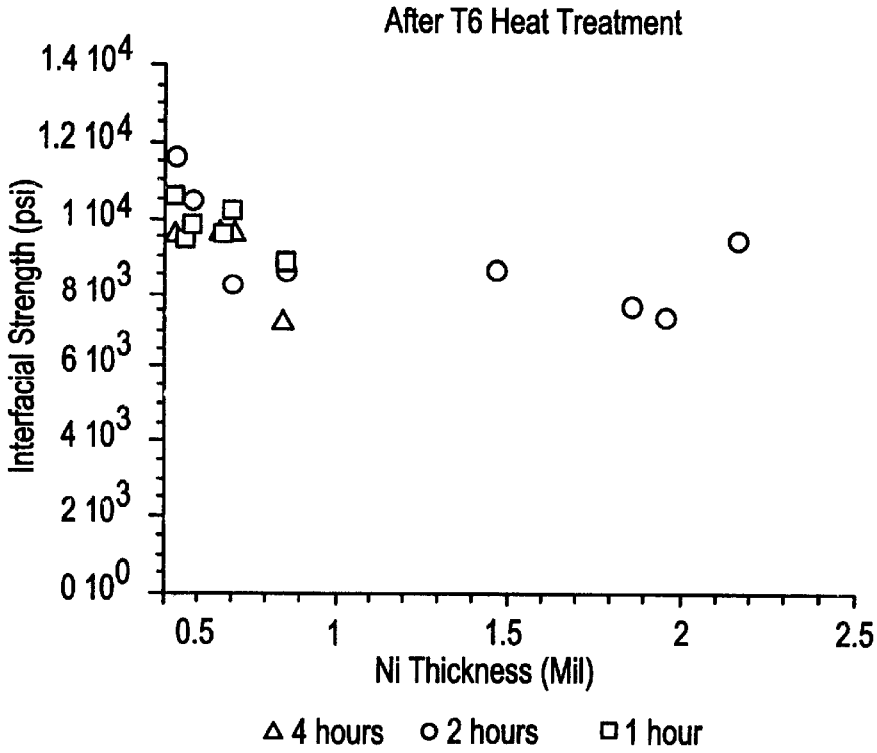
FIG. 15 is a graph illustrating the bond strength of samples formed in accordance with the subject invention after T6 heat treatment using a slow heating rate.
Figure 16:
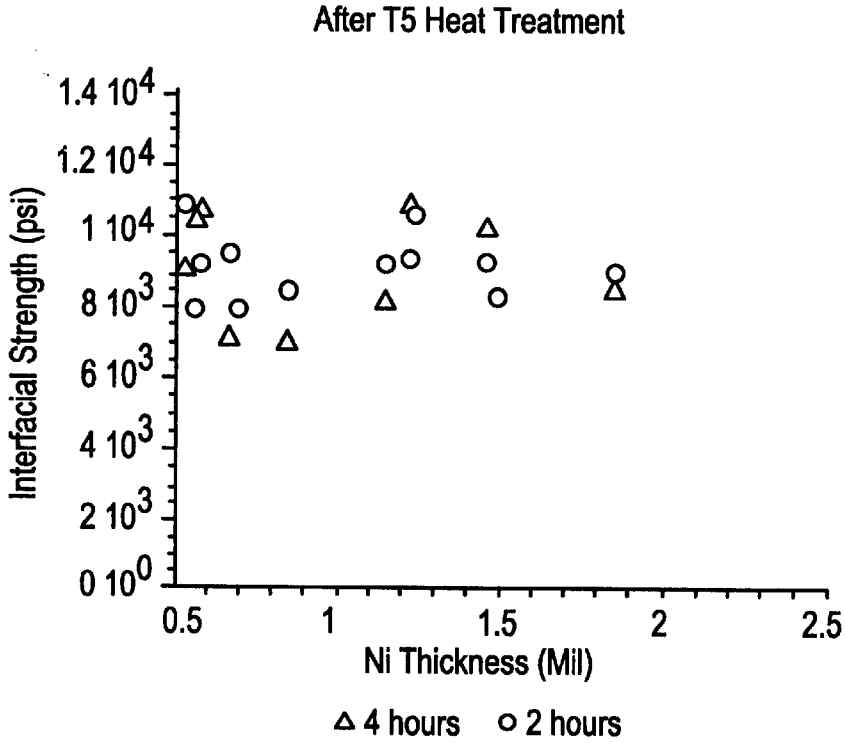
FIG. 16 is a graph illustrating the bond strength of samples formed in accordance with the subject invention after T5 heat treatment.
Figure 17:
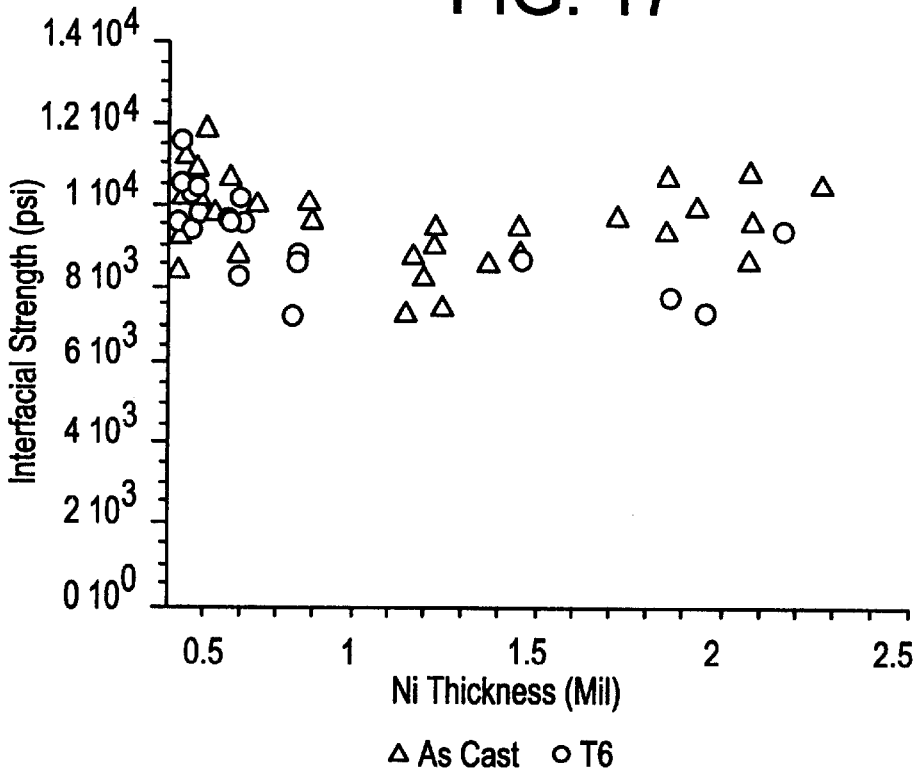
FIG. 17 is a graph illustrating the bond strength of samples formed in accordance with the subject invention for the "as cast" condition and after a T6 heat treatment using a slow heating rate.

FIG. 15 is yet another graph of data derived from testing casting samples made in accordance with the subject invention wherein the bond strength of samples after T6 heat treatment is recorded. This graph demonstrates that the strength is not sensitive to Ni thickness and annealing time. Similarly, FIG. 16 is a graph of data derived from testing casting samples made in accordance with the subject invention demonstrating that bond strength is still high after T5 heat treatment and remains above the strength obtained from prior art Al-Fin processes. This data also demonstrate that diffusion time has little influence on the bond strength. In a related series of tests reported in FIG. 17 bond strength is also not negatively impacted by slow heating rates in T6 heat treatment processes.

Figure 18A:
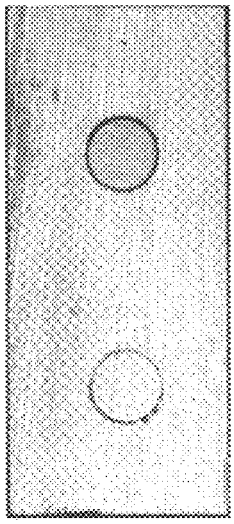
FIGS. 18*a*, 18*b* and 18*c* are micrographs of samples which disclose the effect on bonding in the presence of high, medium and low concentrations of hydrogen.
Figure 18B:
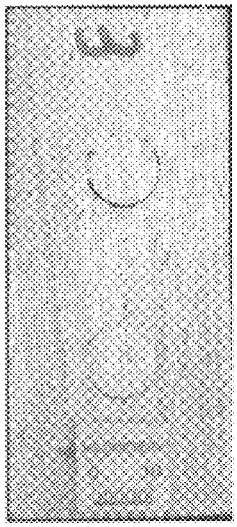
Figure 18C:
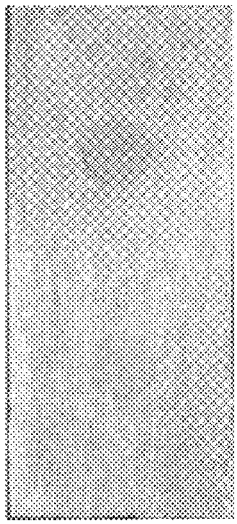

The micrographs of FIGS. 18*a*, 18*b* and 18*c* disclose test samples cast when hydrogen entrainment in the melt was, respectively high, medium and low. These FIGS. demonstrate that reducing hydrogen content in the casting material melt will improve the bond strength.

Figure 19:
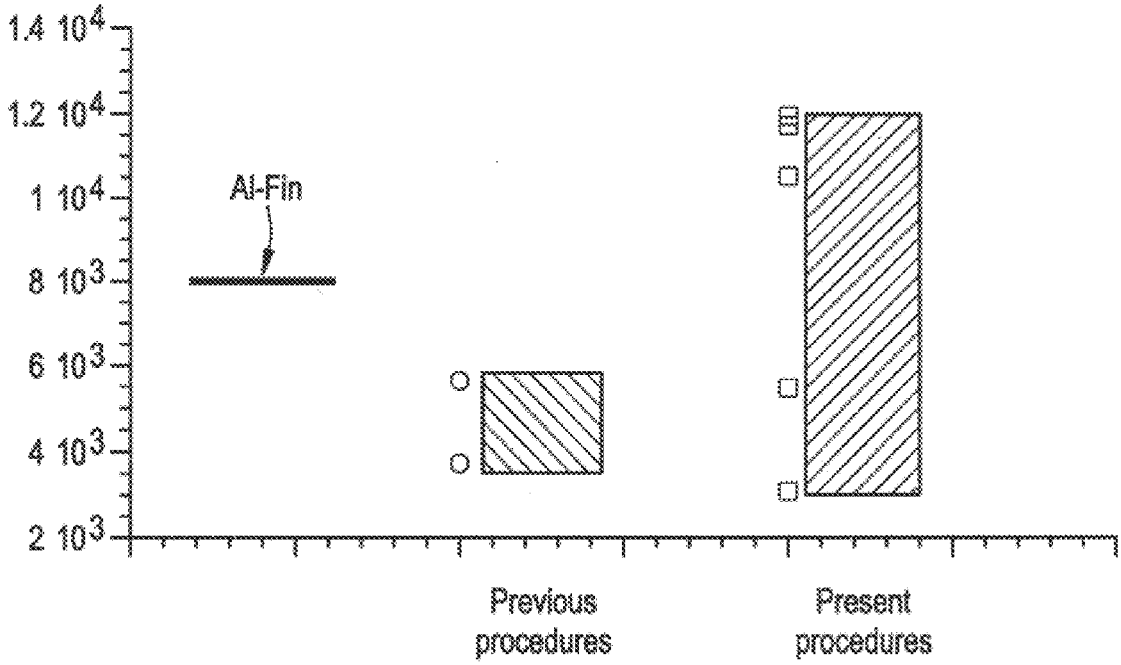
FIG. 19 is a graph illustrating improved interfacial strength achieved by the subject invention.
Figure 20:
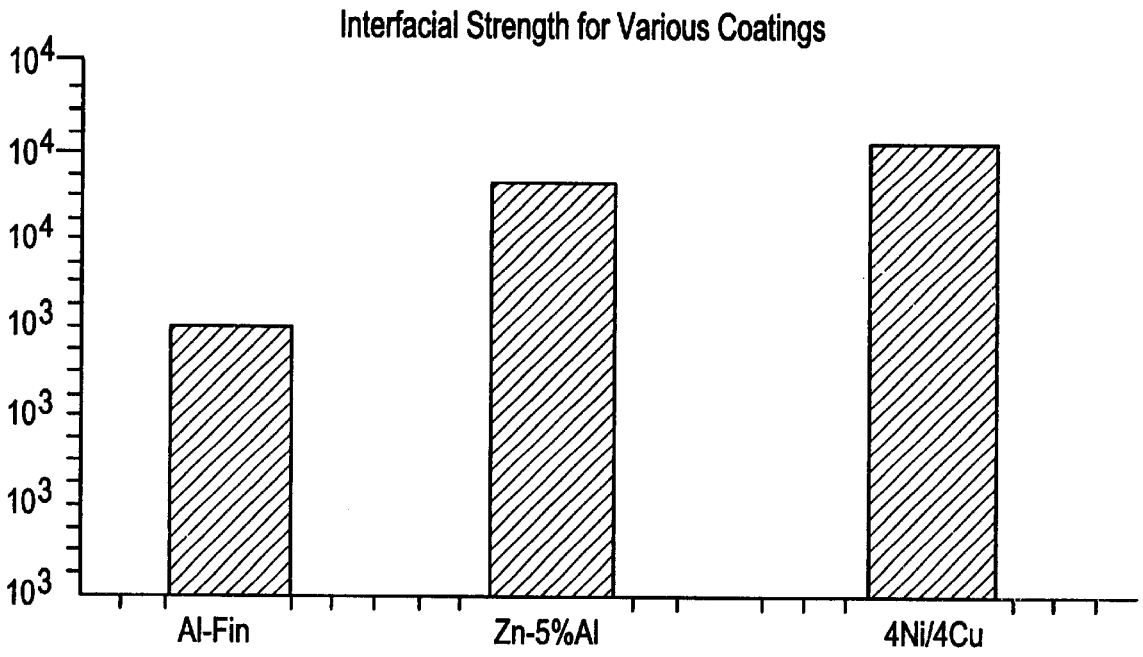
FIG. 20 is a graph illustrating the fact that the highest interfacial strength can be obtained by Ni/Cu coatings.

The graph of FIG. 19 demonstrates the effects of following the improved procedures of the subject invention wherein bond strengths well above the prior art are shown. Among the interfacial bonds tested, the Ni/Cu coating bonds produced the strongest bonds as recorded in the tests reported in FIG. 20.

Figure 21:
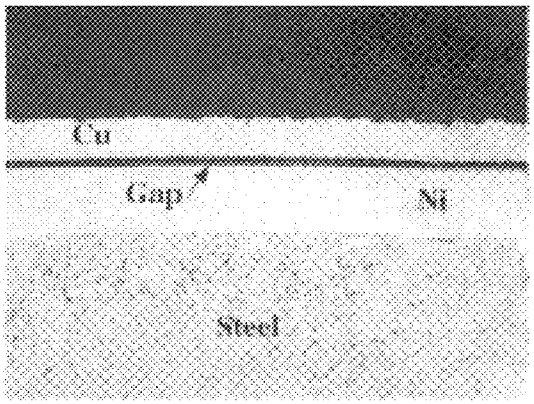
FIG. 21 is a micrograph of a sample in which a gap has formed between coated layers formed by a process that failed to employ the improved coating material choices and temperature fabrication steps of the subject invention.
Figure 22:
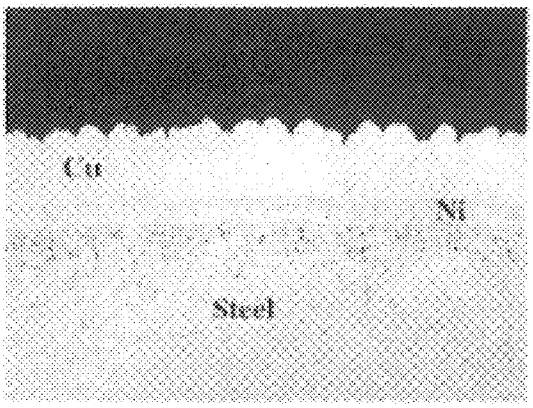
FIG. 22 is a micrograph of improved bonding in a sample which was formed by a process employing the subject invention.

The micrograph of FIG. 21 discloses a sample prepared by prior art techniques wherein a gap between layers is disclosed. In order to eliminate the gap illustrated in FIG. 21, the process of the subject invention was employed. In this process, nickel is plated on steel at 50° C. and cooled to room temperature. Copper is then plated at 40° C. During the plating of the copper layer, the steel/nickel assembly is heated up and expands. Since the copper layer growing on the nickel layer has a higher CTE than the steel/Ni assembly, it "shrinks" onto the nickel assembly upon cooling. As a result, no gap exists between the nickel and the copper layers. A number of steel samples were coated using the new technique. No gaps were observed between the nickel and copper layers. FIG. 22 illustrates the lack of any gap between the steel/nickel assembly and the outer copper with the new electroplating technique.

Figure 23:
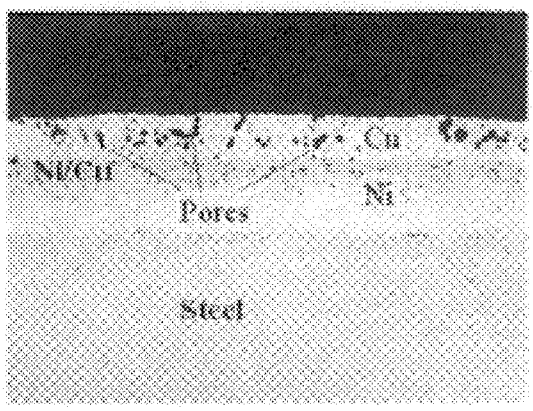
FIG. 23 is a micrograph of a sample having high porosity which is typical of prior art processes.
Figure 24:
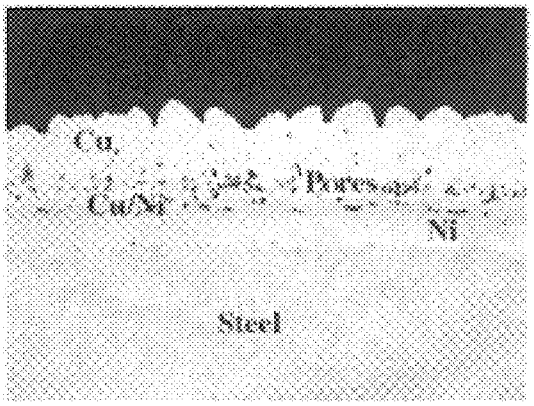
FIG. 24 is a micrograph of a sample having much low porosity as a result of implementation of the subject invention.

The coating techniques described above have been tested experimentally a number of times for multilayered coatings of nickel and copper on the steel. In every case, the nickel/copper interface has been free of defects. This has allowed several different thicknesses of the nickel layer to be tested in order to optimize the nickel layer thickness in terms of the bond strength. In addition, the lack of a gap between the nickel and copper layers has also produced improved coating integrity after the heat treatment step. Samples produced by the old technique contained extensive porosity in the coating layer, with the pores often exposed to the surface. Surface pores often trapped moisture and created defects during casting. Samples produced by the subject invention contained much lower porosity, and the porosity was always contained within the coating, allowing for improved bond integrity after casting. FIG. 23 is a micrograph of a sample made in accordance with prior art techniques and FIG. 24 is a micrograph of a sample made in accordance with the subject invention. FIG. 24 illustrates the improved quality of the coating after heat treatment when the subject invention is used to form the sample.

INDUSTRIAL APPLICABILITY

The subject invention will find broad application to any casting process wherein advantages can be obtained from the substitution of a light weight, insert re-inforced casting for a more conventional heavy metal casting (such as cast iron). The invention has particular applicability to internal combustion engines and still more particularly to heavy duty compression ignition engines used under severe conditions. The components of such engines that have previously been formed of cast iron will now be subject to fabrication in light-weight metal alloys. The significant reduction in weight will produce substantial performance improvements in terms of fuel economy and operating costs.

We claim:

1. A method for forming a tenacious, substantially defect free joint between an insert and a cast metal material having a melting point below the melting point of the insert material, comprising the steps of:

a. coating a thin layer of metallic material a thickness of 0.5 to 8 mils onto the insert wherein the step of coating includes forming the layer from a material selected from the group consisting of Silver, Antimony, Bismuth, Chromium, Gold, Lead, Magnesium, Silicon, Tin, Titanium, and Zinc, and b. casting the cast metal material against the coated surface of said insert under conditions which maximize the metallurgical bonds between the insert and the metallic material of the coating and between the metallic material and the cast metal while reducing hydrogen absorption to create a bond strength above 8000 psi, wherein the insert has a first coefficient of thermal expansion and the cast metal material has a second coefficient of thermal expansion above the first coefficient of thermal expansion and wherein the step of coating includes the step of coating with a metallic material having a third coefficient of thermal expansion greater than the first coefficient of thermal expansion but less than the second coefficient of thermal expansion.

2. The method of claim 1 wherein the step of coating includes the step of coating a layer having a thickness of 0.5 to 2.5 mils.

3. The method of claim 1 further including the step of T5 heat treatment following the casting step.

4. The method of claim 1 further including the step of T6 heat treatment following the casting step.

5. The method of claim 1 wherein said step of casting includes casting within an inert gas environment.

6. The method of claim 5 wherein said step of casting within an inert gas environment includes casting within a gas environment containing primarily argon.

7. The method of claim 5 wherein said step of casting includes casting within a gas environment containing primarily nitrogen.

8. The method of claim 1 wherein said step of casting includes casting within a dry gas environment.

9. The method of claim 8 wherein said step of casting within a dry gas environment includes casting within a dry gas environment containing primarily air.

10. The method of claim 1 further including the step of forming the insert of carbon steel.

11. The method of claim 1 further including the step of forming the insert of stainless steel.

12. The method of claim 1 wherein the step of coating includes the step of electroplating the layer of metallurgical material onto the insert.

13. The method of claim 1 wherein the step of coating includes the step of cleaning the insert in an alkaline bath followed by the step of the acid cleaning.

14. The method of claim 1 includes the step of coating at a temperature of above room temperature.

15. The method of claim 14 further including the step of annealing the coated insert at a temperature of 900° C.

16. The method of claim 1 wherein the step of coating includes coating above room temperature.

17. The method of claim 16 further including the step of annealing the coated insert at a temperature of 900° C.

18. The method of claim 1 wherein the step of coating includes coating at a temperature of 40° to 45° C. and the coating material is Ag.

19. The method of claim 18 further including the step of annealing the coated insert at a temperature of 900° C.

20. The method of claim 1 wherein the casting step includes the steps of forming a mold having an inlet and an outlet and in which the insert may be placed before casting and causing the molten cast material to enter through the inlet, fill the mold and overflow through the outlet to allow a contaminated flow front to exit through the outlet of the mold.

21. A method for forming a metallurgical bond substantially free of defects between a metal insert and a cast metal material, comprising the steps of:

a. coating a first thin layer of metallurgical material having a thickness of 0.5 to 8 mils onto the insert wherein the step of coating includes forming the layer from a material selected from the group consisting of Silver, Antimony, Bismuth, Chromium, Gold, Lead, Magnesium, Silicon, Tin, Titanium, and Zinc, and b. casting the cast metal material against the coated surface of said insert in an protective gas environment, wherein the insert has a first coefficient of thermal expansion and the cast metal material has a second coefficient of thermal expansion above the first coefficient of thermal expansion and wherein the step of coating includes the step of coating with a metallic material having a third coefficient of thermal expansion greater than the first coefficient of thermal expansion but less than the second coefficient of thermal expansion.

22. The method of claim 21 further including the step of forming the insert out of carbon steel.

23. The method of claim 21 further including the step of forming the insert out of stainless steel.

24. The method of claim 21 wherein the step of coating includes the step of electroplating the layer of metallic material onto the insert.

25. The method of claim 21 wherein the step of coating includes the step of cleaning the insert in an alkaline bath followed by the step the acid cleaning.

26. The method of claim 21 wherein the step of coating includes coating at a temperature of 50° to 55° C.

27. The method of claim 26 further including the step of annealing the coated insert at a temperature of 900° C.

28. The method of claim 21 wherein the step of coating includes coating at a temperature of 40° to 45° C. and the coating material is Ag.

29. The method of claim 28 further including the step of annealing the coated insert at a temperature of 900° C.

30. The method of claim 21 further wherein the casting step is preceded by the step of heating the coated insert to a temperature of at least 100° C. for a period of at least 5 minutes.

31. The method of claim 21 further wherein the casting step includes the step of heating the cast material to a temperature of 720° C. and degassing of the molten cast material.

32. The method of claim 21 wherein the cast material is A354 or 354 aluminum alloy.

33. The method of claim 21 wherein the casting step includes the step of forming a sand mold and inserting the insert into the sand mold.

34. The method of claim 21 wherein the casting step includes the steps of forming a mold having an inlet and an outlet and in which the insert may be placed before casting and causing the molten cast material to enter through the inlet, fill the mold and overflow through the outlet to allow a contaminated flow front to exit through the outlet of the mold.

35. A method for forming a tenacious, substantially defect free joint between an insert and a cast metal material having a melting point below the insert material, comprising the steps of:

a. coating a thin layer of a metallic material onto the insert wherein the step of coating includes forming the layer from a material selected from the group consisting of Silver, Antimony, Bismuth, Chromium, Gold, Lead, Magnesium, Silicon, Tin, Titanium, and Zinc, b. casting the cast metal material against the coated surface of said insert under conditions which maximize the metallurgical bonds between the insert and thin layer of metallic material and between said thin layer and the cast metal while reducing hydrogen absorption to create a bond strength above 8000 psi;

wherein the insert has a first coefficient of thermal expansion, the first metallic material has a second coefficient of thermal expansion, and the cast metal material has a third coefficient of thermal expansion and wherein the second coefficient of thermal expansion is greater than the first and less than the third coefficient of thermal expansion.

36. The method of claim 35 wherein the casting step is carried out under conditions including a temperature to cause only a portion of the coated layer to be sacrificed by dissolving into the cast metal material while leaving at least a portion of the coated layer as a diffusion barrier between the insert and the cast material.

37. The method of claim 35 wherein the casting step includes the steps of forming a mold having an inlet and an outlet and in which the insert may be placed before casting and causing the molten cast material to enter through the inlet, fill the mold and overflow through the outlet to allow a contaminated flow front to exit through the outlet of the mold.

38. The method of claim 35 wherein the steps of coating the thin layer includes the step of coating a layer having a thickness of 0.5 to 8 mils.

39. The method of claim 35 further including the step of T5 heat treatment following the casting step leaving an interfacial strength above $7\times10^3$ psi.

40. The method of claim 35 further including the step of T6 heat treatment following the casting step leaving an interfacial strength above $7\times10^3$ psi.

41. The method of claim 35 wherein said step of casting includes the step of casting within an inert gas environment.

42. The method of claim 41 wherein said step of casting within an inert gas environment includes casting within a gas environment containing primarily argon.

43. The method of claim 41 wherein said step of casting within an inert gas environment includes casting within a gas environment containing primarily nitrogen.

44. The method of claim 35 wherein said step of casting includes casting within a dry gas environment.

45. The method of claim 44 wherein said step of casting within a dry gas environment includes casting within a dry gas environment containing primarily air.

46. The method of claim 35 further including the step of forming the insert of carbon steel.

47. The method of claim 35 further including the step of forming the insert of stainless steel.

48. The method of claim 35 further including the step of forming the cast material of aluminum alloy.

49. The method of claim 35 wherein the aluminum alloy is A354 or 354 aluminum alloy.

50. The method of claim 35 wherein the step of coating the layer includes the step of electroplating the layer of metallic material.

51. The method of claim 35 wherein the step of coating includes the preliminary step of anodic cleaning the insert in an alkaline bath followed by the step of acid cleaning.

52. The method of claim 35 wherein the step of coating is at a temperature of 50° to 55° C.

53. The method of claim 52 further including the step of annealing the coated insert at a temperature of 900° C.

54. The method of claim 35 wherein the step of coating includes coating at a temperature of 40° to 45° C.

55. The method of claim 54 further including the step of annealing the coated insert at a temperature of 900° C.

56. The method of claim 35 wherein the step of coating includes coating at a temperature of 40° to 45° C. and the coating material is Ag.

57. The method of claim 56 further including the step of annealing the coated insert at a temperature of 900° C.

58. The method of claim 1 further wherein the casting step includes the step of heating the cast material to a suitable temperature and degassing of the molten cast material to a point where the amount of hydrogen entrained is less than 0.15 parts per million.

59. The method of claim 58 further wherein the casting step includes the step of heating the cast material to a suitable casting temperature and degassing of the molten cast material to a point where the amount of hydrogen entrained is less than 0.10 parts per million.

60. The method of claim 1 wherein thin layer is coated to a thickness of 0.5 to 4 mils.

61. The method of claim 60 wherein the thin layer is coated to a thickness of 0.5 to 2 mils.

62. The method of claim 35 wherein thin layer is coated to a thickness of 0.5 to 4 mils.

63. The method of claim 62 wherein the thin layer is coated to a thickness of 0.5 to 2 mils.

64. The method of claim 21 wherein the protective gas environment is argon, nitrogen or dry air.

65. The method of claim 1 including providing a mold designed to direct the flow of the molten casting material into sections of the mold after the molten casting material flows over the coated insert surfaces to allow contaminants to be carried away from the coated surfaces to cause the molten casting material, most likely to be contaminated with oxides and inclusions, to be directed away from the interface between the insert and casting material.

* * * * *